US008451177B2

(12) United States Patent
Shau et al.

(10) Patent No.: US 8,451,177 B2
(45) Date of Patent: May 28, 2013

(54) WIDEBAND ANTENNA

(75) Inventors: Jen-Min Shau, Hsinchu (TW); Hsiao-Yi Lin, Hsinchu (TW); Wei-Shan Chang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 281 days.

(21) Appl. No.: 12/878,038

(22) Filed: Sep. 9, 2010

(65) Prior Publication Data

US 2012/0001803 A1 Jan. 5, 2012

(30) Foreign Application Priority Data

Jul. 2, 2010 (TW) ..... 99212632 U

(51) Int. Cl.
*H01Q 1/38* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS

| | | | | |
|---|---|---|---|---|
| 7,336,229 | B1 * | 2/2008 | Tseng et al. | 343/702 |
| 2003/0132882 | A1 * | 7/2003 | Wong et al. | 343/700 MS |
| 2004/0066334 | A1 | 4/2004 | Fang et al. | |
| 2007/0030198 | A1 * | 2/2007 | Wei | 343/700 MS |
| 2007/0030203 | A1 * | 2/2007 | Tsai et al. | 343/702 |

* cited by examiner

*Primary Examiner* — Dieu H Duong
(74) *Attorney, Agent, or Firm* — Winston Hsu; Scott Margo

(57) ABSTRACT

A wideband antenna for a radio transceiver device includes a first radiating element for transmitting and receiving wireless signals of a first frequency band, a second radiating element for transmitting and receiving wireless signals of a second frequency band, a grounding unit, a connection strip having one end coupled to the first radiating element and the second radiating element, and another end coupled to the grounding unit, and a feeding terminal coupled to the connection strip for transmitting wireless signals of the first frequency band and the second frequency band. The second frequency band is lower than the second frequency band, and the connection strip includes a structure extending toward the first radiating element.

7 Claims, 25 Drawing Sheets

WIDEBAND ANTENNA

BACKGROUND OF THE INVENTION

1. Field of the Invention

The present invention relates to a wideband antenna, and more particularly, to a wideband antenna capable of uniformly distributing current on a low-frequency radiating element to obtain better omnidirectional radiation and increase the low frequency bandwidth.

2. Description of the Prior Art

An electronic product having a communication function, such as a laptop computer, a personal digital assistant, etc., uses an antenna to transmit or receive radio waves, so as to transfer or exchange radio signals, and access wireless network. Therefore, in order to let a user to access wireless network more conveniently, a bandwidth of an ideal antenna should be extended as broadly as possible within a tolerable range, while a size thereof should be minimized as much as possible, to meet a main stream of reducing a size of the electronic product.

Planar Inverted-F Antenna (PIFA) is a monopole antenna commonly used in a radio transceiver device. As implied in the name, a shape of PIFA is similar to an inverted and rotated "F". PIFA has advantages of low production cost, high radiation efficiency, easily realizing multi-channel operations, etc. However, a size or arrangement of PIFA is usually fixed, such that input and output impedances of the antenna cannot be easily adjusted. Therefore, in order to improve abovementioned drawbacks, applicant of the present invention has provided a dualband antenna 10 in U.S. Pat. No. 6,861,986, as shown in FIG. 1. The dualband antenna 10 has a simplified structure, and can reduce the number of strips efficiently.

With developments of a variety of wireless communication systems, transmission efficiency of a low frequency band is requested. Therefore, to increase the low frequency bandwidth of the dualband antenna 10 is a goal the applicant works for.

SUMMARY OF THE INVENTION

It is therefore a primary objective of the claimed invention to provide a wideband antenna.

The present invention discloses a wideband antenna for a radio transceiver device which comprises a first radiating element, for transmitting and receiving wireless signals of a first frequency band; a second radiating element, for transmitting and receiving wireless signals of a second frequency band; a grounding unit; a connection strip, having an end coupled to the first radiating element and the second radiating element, and another end coupled to the grounding unit; and a feeding terminal, coupled to the connection strip, for transmitting and receiving wireless signals of the first frequency band and the second frequency band; wherein the second frequency band is lower than the first frequency band and the connection strip comprises a structure extending toward the first radiating element.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
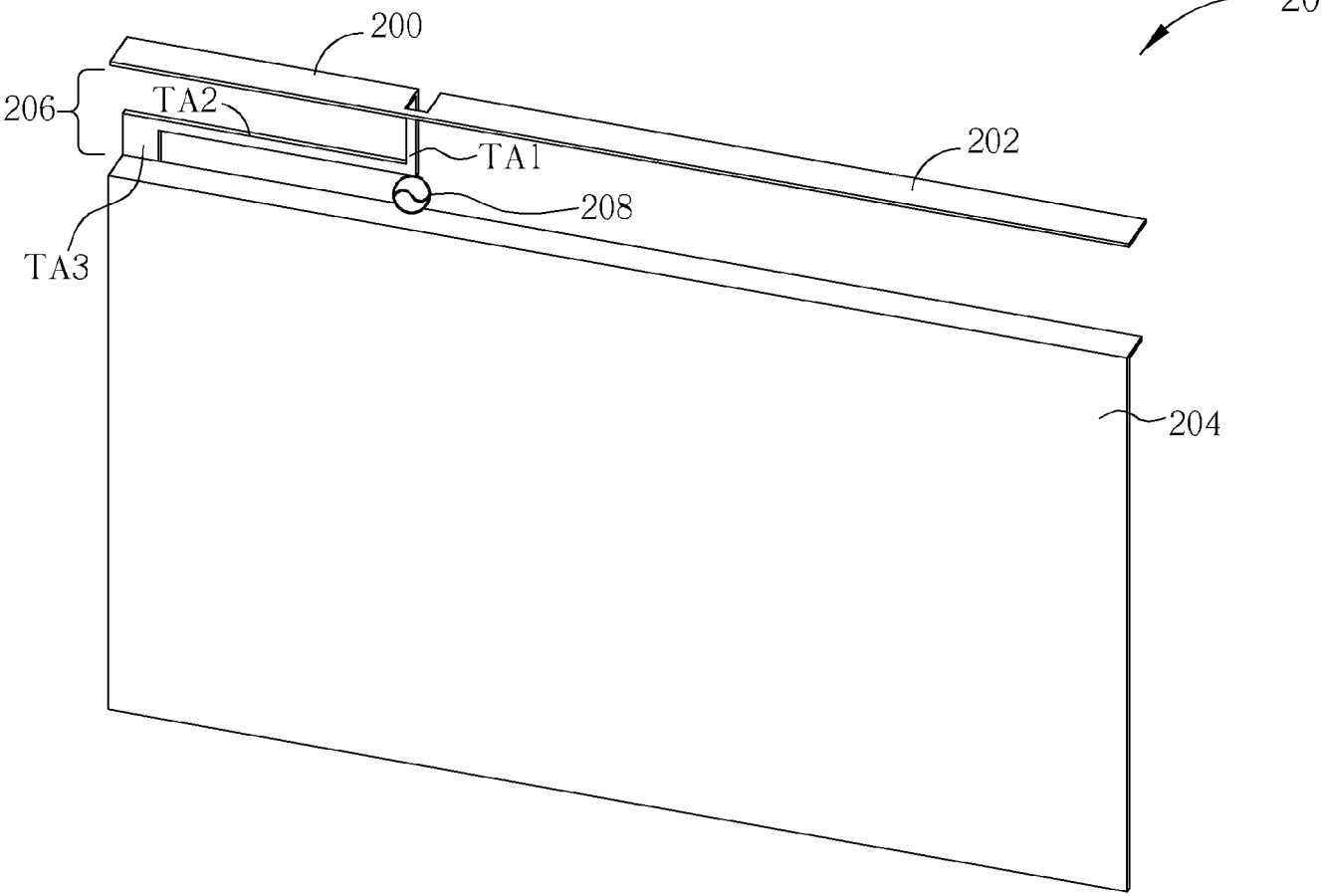
FIG. 2 is a schematic diagram of a dualband wideband antenna according to an embodiment of the present invention.

Please refer to FIG. 2, which illustrates a schematic diagram of a dualband wideband antenna 20 according to an embodiment of the present invention. The dualband wideband antenna 20 is utilized in a radio transceiver device, and comprises a first radiating element 200, a second radiating element 202, a grounding unit 204, a connection strip 206 and a feeding terminal 208. The first radiating element 200 and the second radiating element 202 are used for transmitting and receiving radio frequency (RF) signals of two different frequency bands respectively, and the connection strip 206 is used for connecting the first radiating element 200, the second radiating element 202, the grounding unit 204 and the feeding terminal 208. An operation principle of the dualband wideband antenna 20 is well-known in the art, and is concisely depicted as follows.

When transmitting an RF signal of a specific frequency, the radio transceiver device transmits the RF signal to the feeding terminal 208, and conducts current from the connection strip 206 to the first radiating element 200 and the second radiating element 202. One of the first radiating element 200 and the second radiating element 202, which matches with the RF signal, can generate resonance, so as to output electromagnetic waves. When receiving an RF signal, the first radiating element 200 or the second radiating element 202 resonates with electromagnetic waves related to the RF signal and transforms the electromagnetic waves to a current signal, and the connection strip 206 conducts the current signal to the radio transceiver device via the feeding terminal 208.

Figure 1:
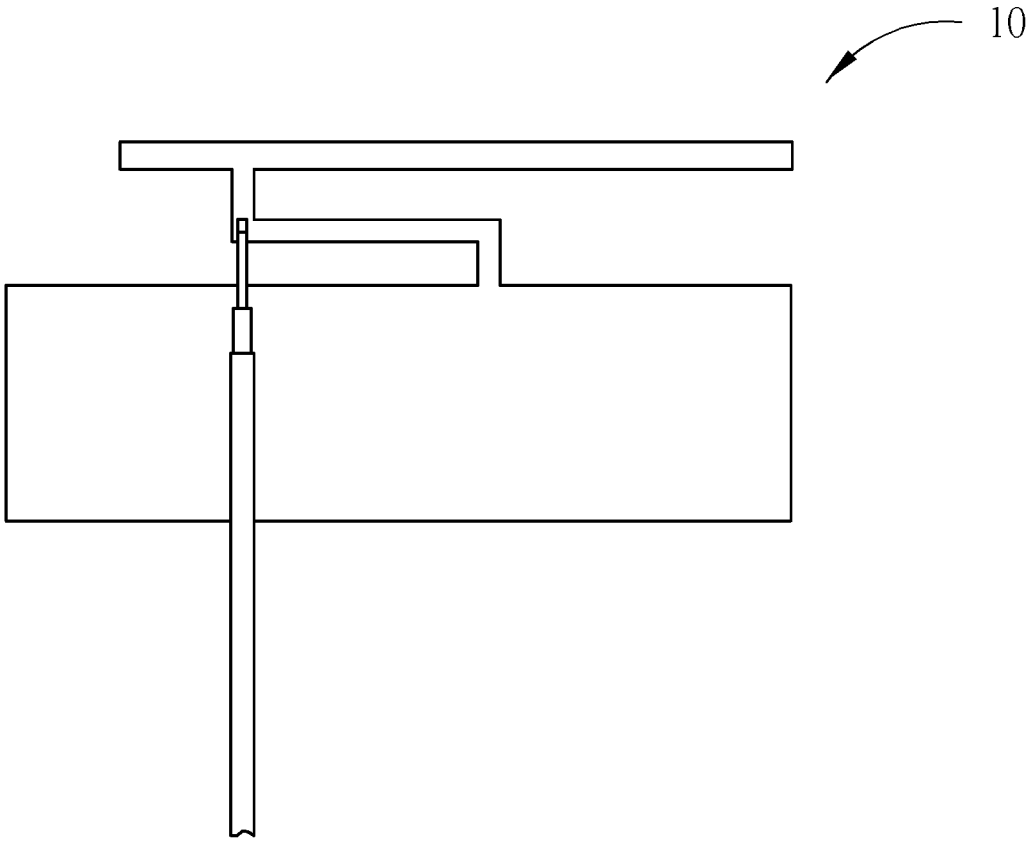
FIG. 1 PRIOR ART
FIG. 1 is a schematic diagram of a dualband antenna according to the prior art.

Comparing FIG. 1 with FIG. 2, the structure of the dualband wideband antenna 20 is similar to that of the dualband antenna 10. However, the dualband wideband antenna 20 can increase a bandwidth of low frequency portion (i.e. a frequency band corresponding to the second radiating element 202) with the connection strip 206. More specifically, the connection strip 206 comprises a first arm TA1, a second arm TA2 and a third arm TA3, and is preferably a monocoque structure. As shown in FIG. 2, the first arm TA1 extends from a connection place of the first radiating element 200 and the second radiating element 202 toward the grounding unit 204. The second arm TA2 includes one end coupled to the first arm TA1 and another end extending toward the first radiating element 200. The third arm TA3 is coupled to the second arm TA2 and the grounding unit 204. In short, the connection strip 206 extends toward a high frequency radiating element of the dualband wideband antenna 20, i.e. the first radiating element 200. In such a situation, current can be uniformly distributed on the second radiating element 202. As a result, better omnidirectional radiation can be obtained.

Figure 3:
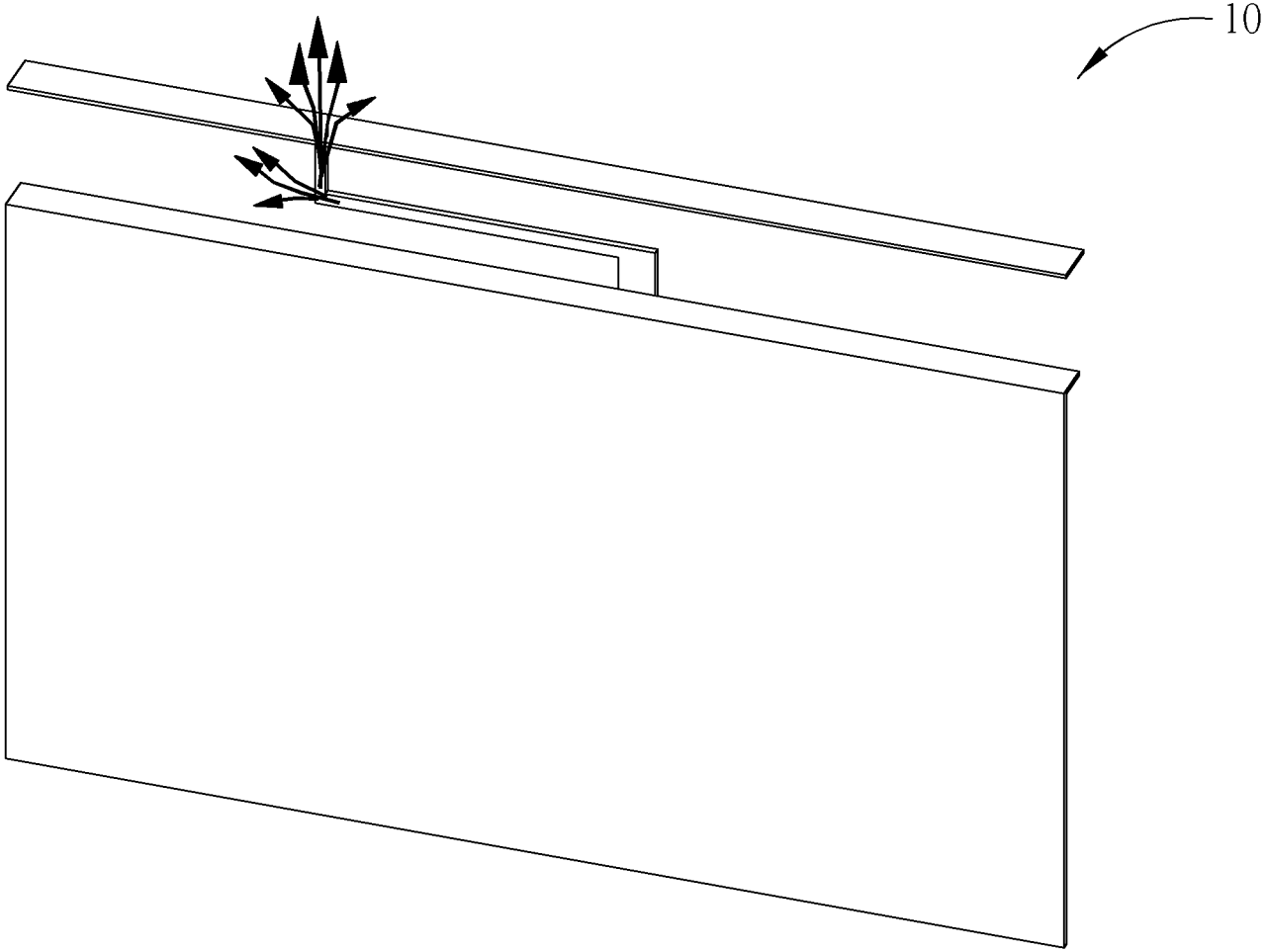
FIG. 3 is a schematic diagram of a current distribution of the dualband antenna shown in FIG. 1.
Figure 4:
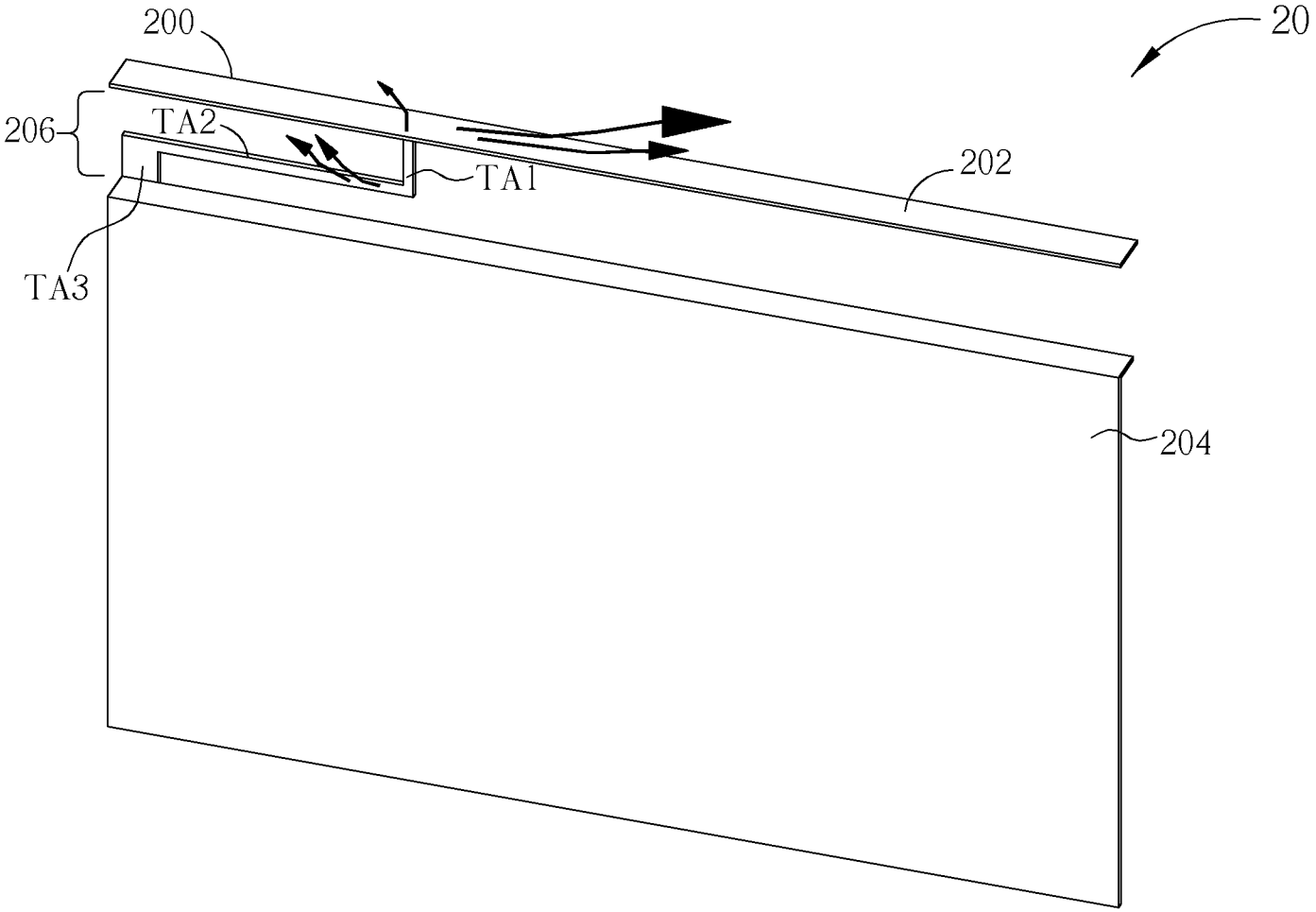
FIG. 4 is a schematic diagram of a current distribution of the dualband wideband antenna shown in FIG. 2.
Figure 5:
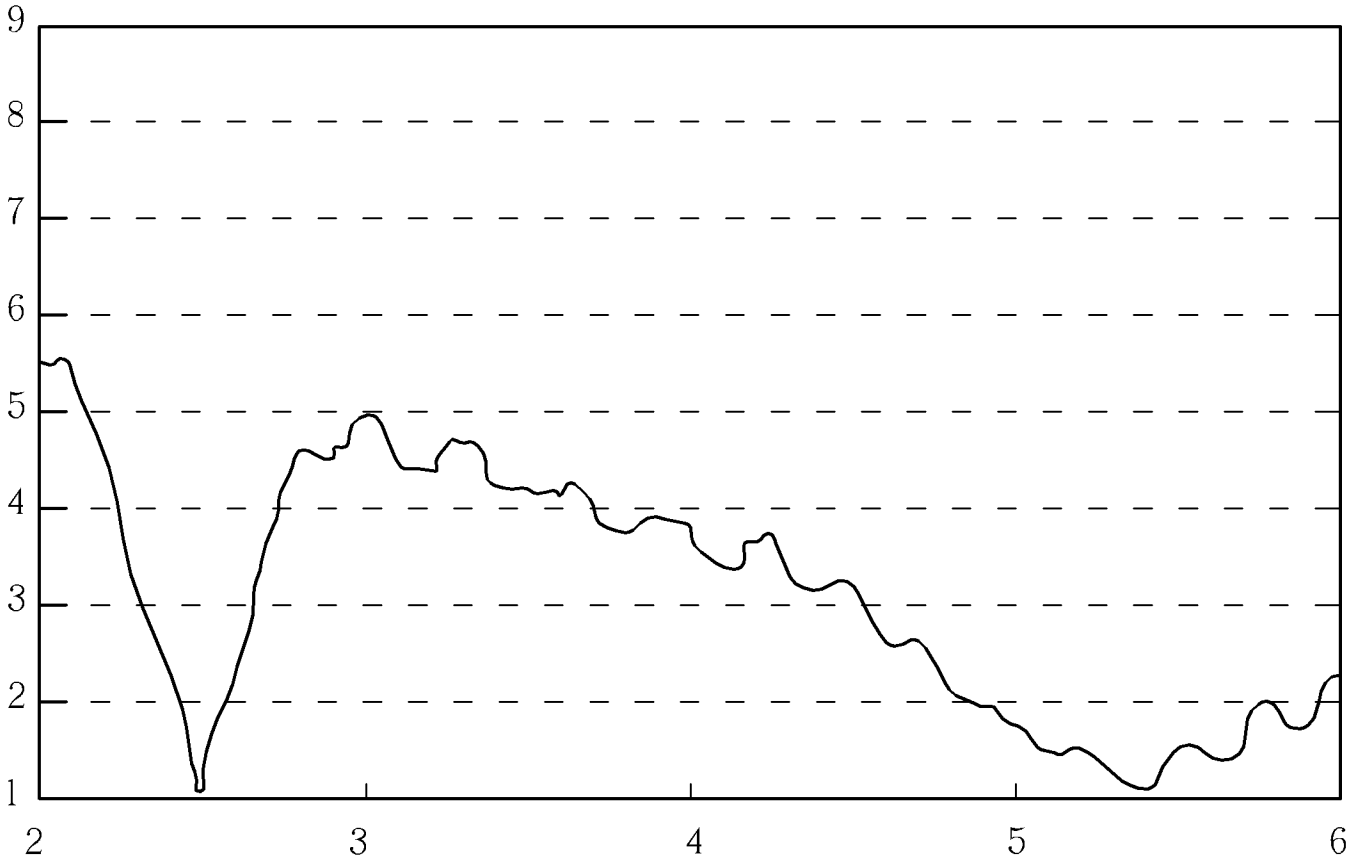
FIG. 5 is a schematic diagram of voltage to standing wave ratio (VSWR) of the dualband antenna shown in FIG. 1 at 2 GHz to 6 GHz.
Figure 6A:
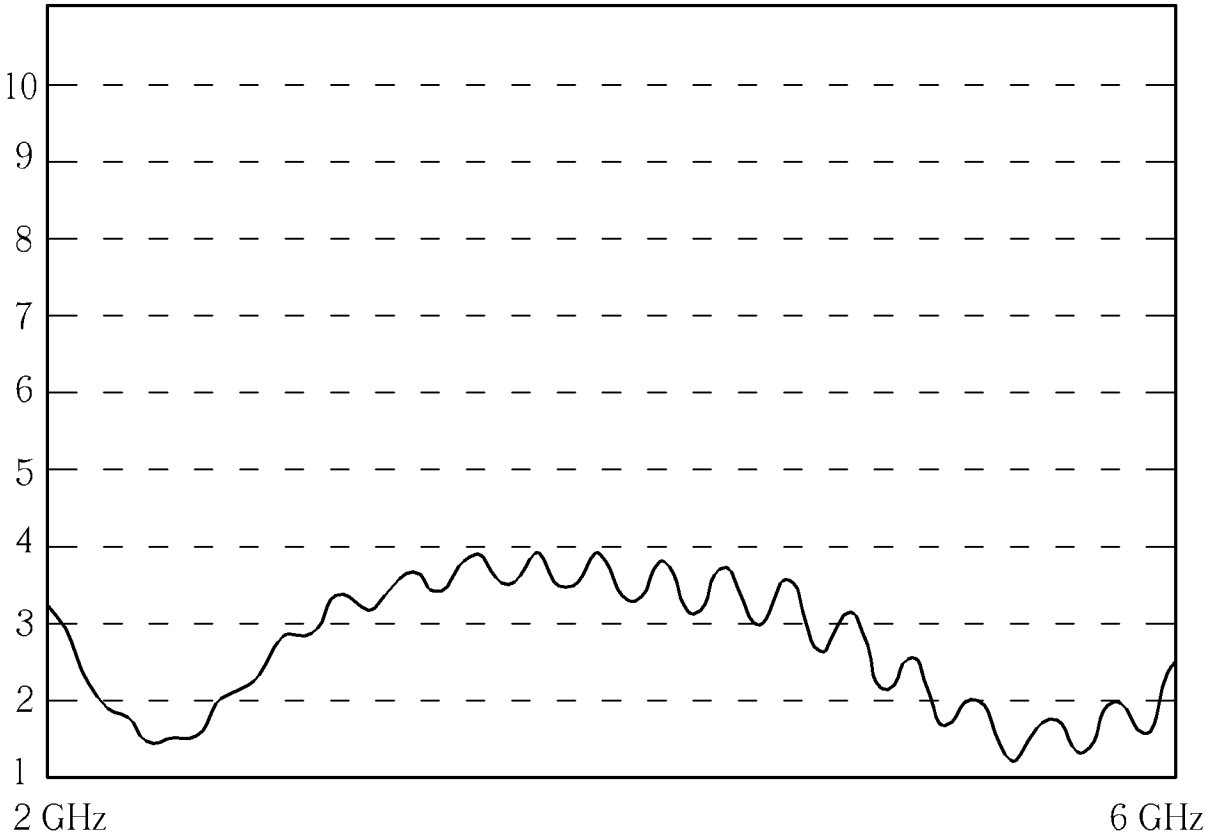
FIG. 6A is a schematic diagram of VSWR of the dualband wideband antenna shown in FIG. 2 at 2 GHz to 6 GHz.
Figure 6B:
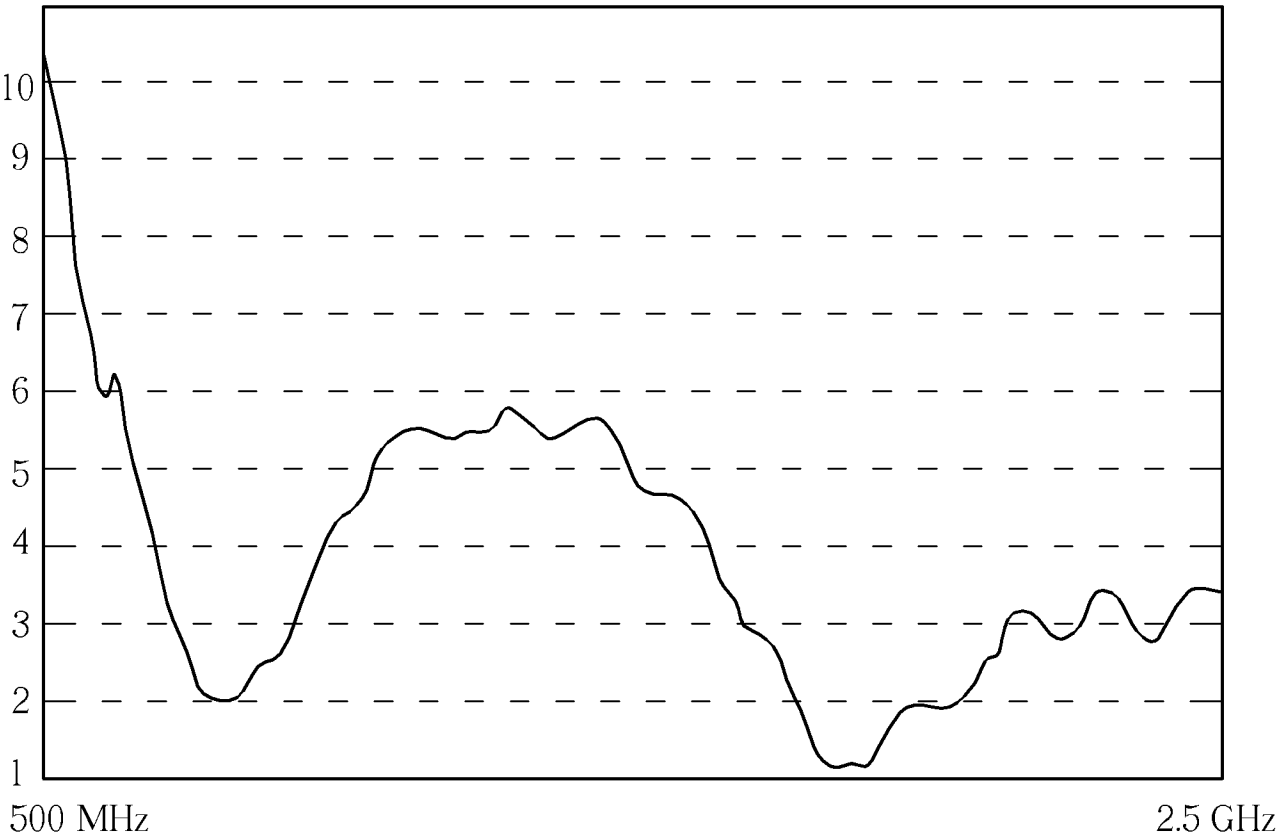
FIG. 6B is a schematic diagram of VSWR of the dualband wideband antenna shown in FIG. 2 at 0.5 GHz to 2.5 GHz.

Please refer to FIG. 3 and FIG. 4 for further description of the abovementioned concept. FIG. 3 and FIG. 4 illustrate schematic diagrams of current distribution of the dualband antenna 10 shown in FIG. 1 and the dualband wideband antenna 20 shown in FIG. 2 when outputting the same RF signal. As shown in FIG. 3 and FIG. 4, current on the dualband antenna 10 is not uniformly distributed because the connection strip thereof extends toward the low frequency portion; in comparison, the connection strip of the dualband wideband antenna 20 extends toward the high frequency portion (i.e. the first radiating element 200), such that current on the dualband wideband antenna 20 is uniformly distributed, and thus, the low frequency bandwidth is increased. For further proof, please refer to FIG. 5, FIG. 6A and FIG. 6B. FIG. 5 illustrates a schematic diagram of voltage to standing wave ratio (VSWR) of the dualband antenna 10 at 2 GHz to 6 GHz. FIG. 6A and FIG. 6B illustrates schematic diagrams of VSWR of the dualband wideband antenna 20 at 2 GHz to 6 GHz and at 0.5 GHz to 2.5 GHz, respectively. As shown in FIG. 5, the low frequency bandwidth (around 2.45 GHz, and VSWR≦3) of the dualband antenna 10 is about 340 MHz and the bandwidth efficiency is about (340/2450)*100%=13.8%. As shown in FIG. 6A, the low frequency bandwidth (around 2.5 GHz, and VSWR≦3) of the dualband wideband antenna 20 is about 860 MHz and the bandwidth efficiency is about (860/2550)*100%=34.4%. As shown in FIG. 6B, the ultra low frequency bandwidth (around 822 MHz, and VSWR≦3) of the dualband wideband antenna 20 is about 196 MHz and the bandwidth efficiency is about (196/822)*100%=23.8%. Therefore, the high frequency bandwidth of the dualband wideband antenna 20 approximates that of the dualband antenna 10, but the low frequency bandwidth of the dualband wideband antenna 20 is wider than that of the dualband antenna 10.

Figure 7A:
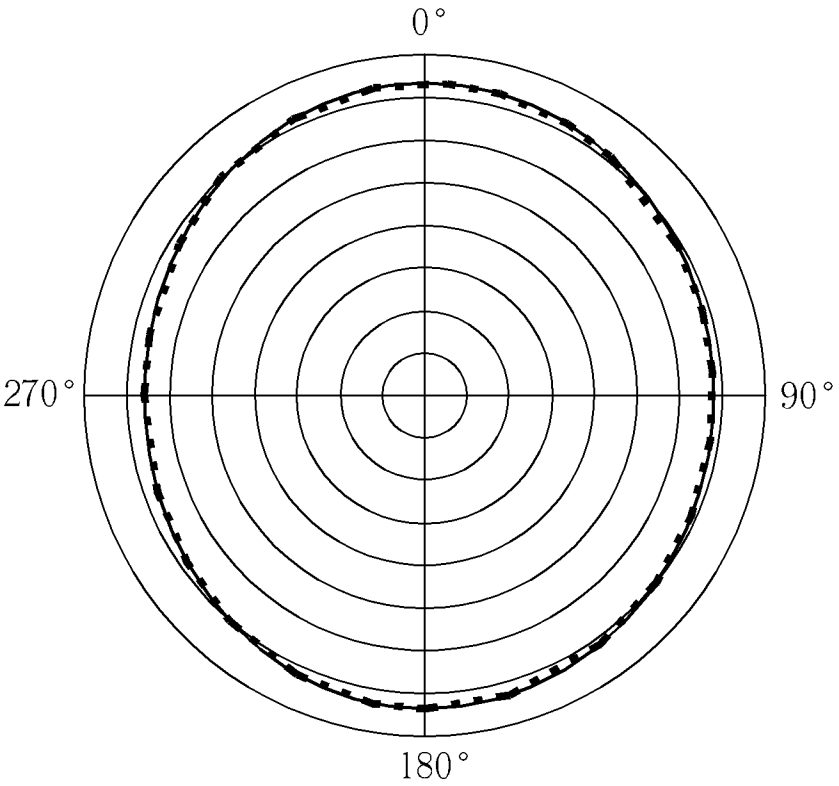
FIG. 7A is a schematic diagram of a horizontal radiation field of the dualband wideband antenna shown in FIG. 2 at 840 MHz.
Figure 7B:
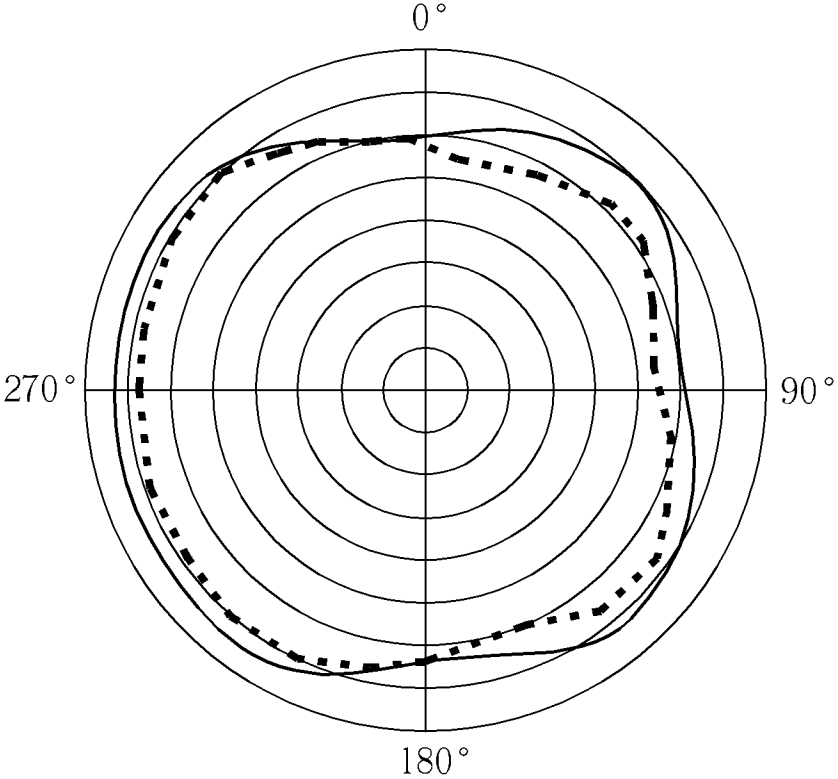
FIG. 7B is a schematic diagram of a horizontal radiation field of the dualband wideband antenna shown in FIG. 2 at 2 GHz.

Furthermore, please refer FIG. 7A and FIG. 7B. FIG. 7A and FIG. 7B illustrate schematic diagrams of horizontal radiation fields of the dualband antenna 10 and the dualband wideband antenna 20 at 840 MHz and 2 GHz respectively. In FIG. 7A and FIG. 7B, dash lines represent the horizontal radiation fields of the dualband antenna 10, and solid lines represent the horizontal radiation fields of the dualband wideband antenna 20. As can be seen from FIG. 7A and FIG. 7B, the dualband wideband antenna 20 and the dualband antenna 10 are both omnidirectional at 840 MHz; however, the omnidirectional characteristic of the dualband wideband antenna 20 at 2 GHz is better than that of the dualband antenna 10.

Therefore, experimental results shown in FIG. 5, FIG. 6A, FIG. 6B, FIG. 7A and FIG. 7B can prove that the dualband wideband antenna 20 has better omnidirectional radiation and wider low frequency bandwidth.

Figure 8A:
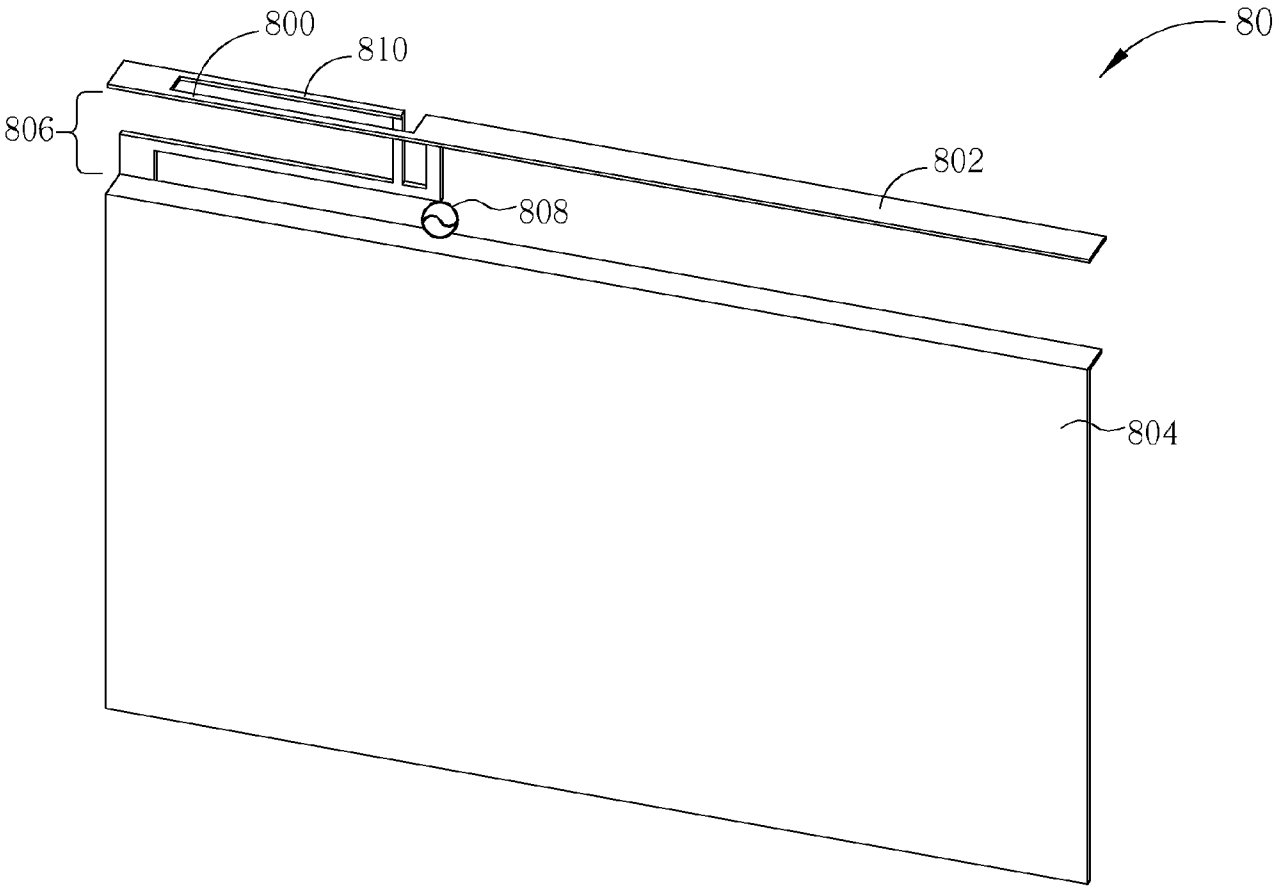
FIG. 8A is a schematic diagram of a dualband wideband antenna according to an embodiment of the present invention.
Figure 8B:
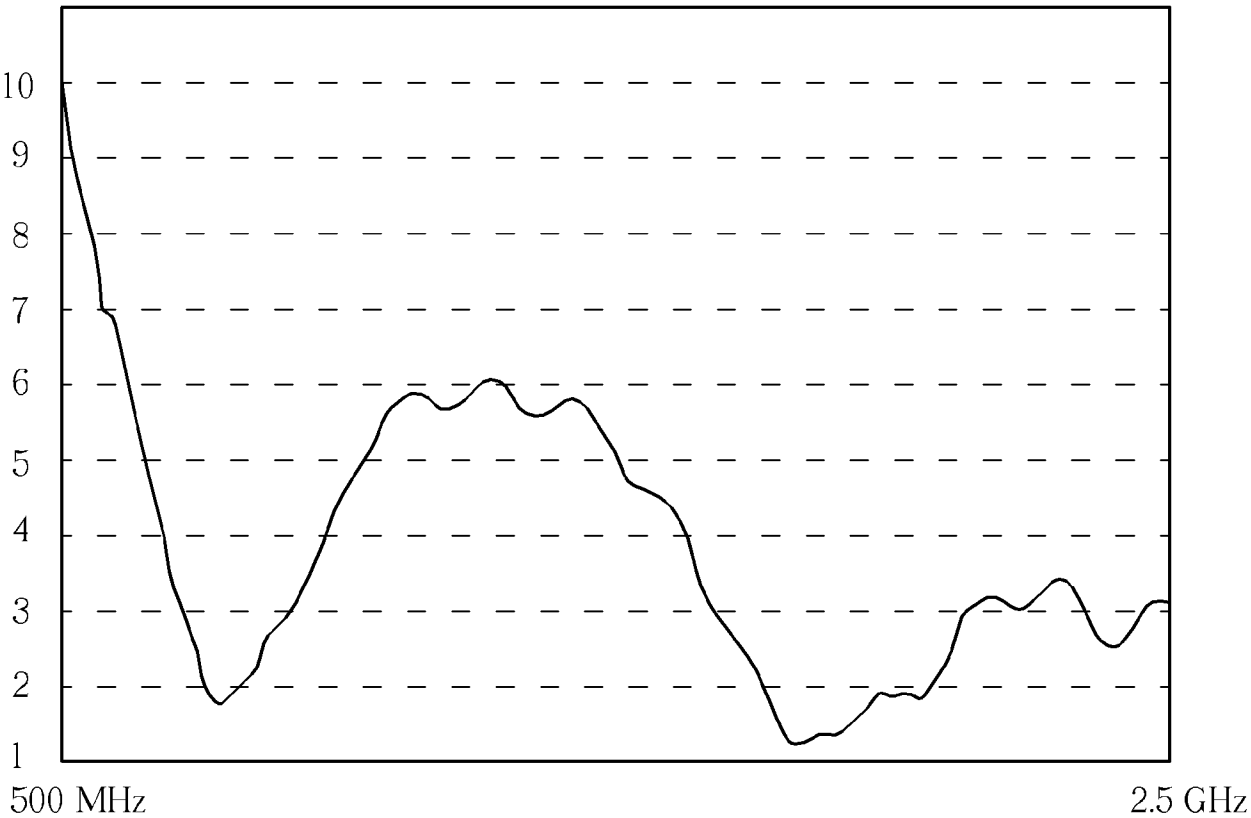
FIG. 8B is a schematic diagram of VSWR of the dualband wideband antenna shown in FIG. 8A at 0.5 GHz to 2.5 GHz.

Note that, the dualband wideband antenna 20 shown in FIG. 2 is an embodiment of the present invention, and those skilled in the art can make alternations and modifications accordingly. For example, a length of the first radiating element 200 or the second radiating element 202 should be designed to a quarter length of the corresponding radio signal, which conforms to the electromagnetic principle of the prior art. In addition, the dualband wideband antenna 20 is used for dualband applications and can further enhance the matching effect with appropriate modifications or derives multi-band wideband antennas. For example, please refer FIG. 8A and FIG. 8B. FIG. 8A illustrates a schematic diagram of a dualband wideband antenna 80 according to an embodiment of the present invention, and FIG. 8B illustrates a schematic diagram of VSWR of the dualband wideband antenna 80 at 0.5 GHz to 2.5 GHz. The dualband wideband antenna 80 is utilized for a radio transceiver device, and comprises a first radiating element 800, a second radiating element 802, a grounding unit 804, a connection strip 806, a feeding terminal 808 and a connection unit 810. Comparing FIG. 2 with FIG. 8A, the structure of the dualband wideband antenna 80 is similar to that of the dualband wideband antenna 20, while the dualband wideband antenna 80 includes the extra connection unit 810 in comparison with the dualband wideband antenna 20. The connection unit 810 extends from the connection strip 806, and is coupled to the first radiating element 800, for enhancing the matching effect. Therefore, the dualband wideband antenna 80 can reach better radiation efficiency after properly adjusting a length or material of the connection unit. As shown in FIG. 8B, an ultra low frequency bandwidth (around 815 MHz, and VSWR≦3) of the dualband wideband antenna 80 is about 200 MHz and the bandwidth efficiency is about (200/815)*100%=24.5%.

Figure 9A:
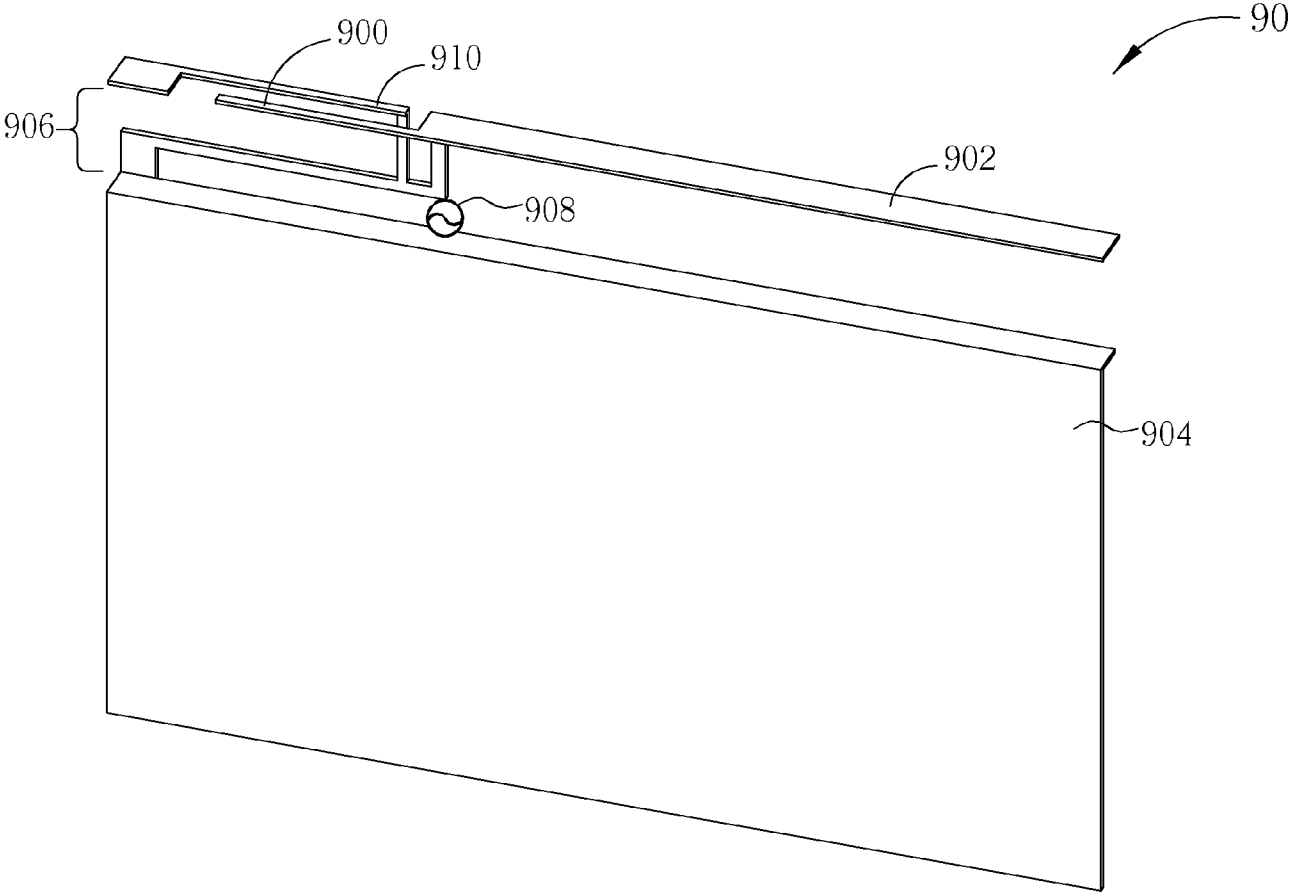
FIG. 9A is a schematic diagram of a dualband wideband antenna according to an embodiment of the present invention.
Figure 9B:
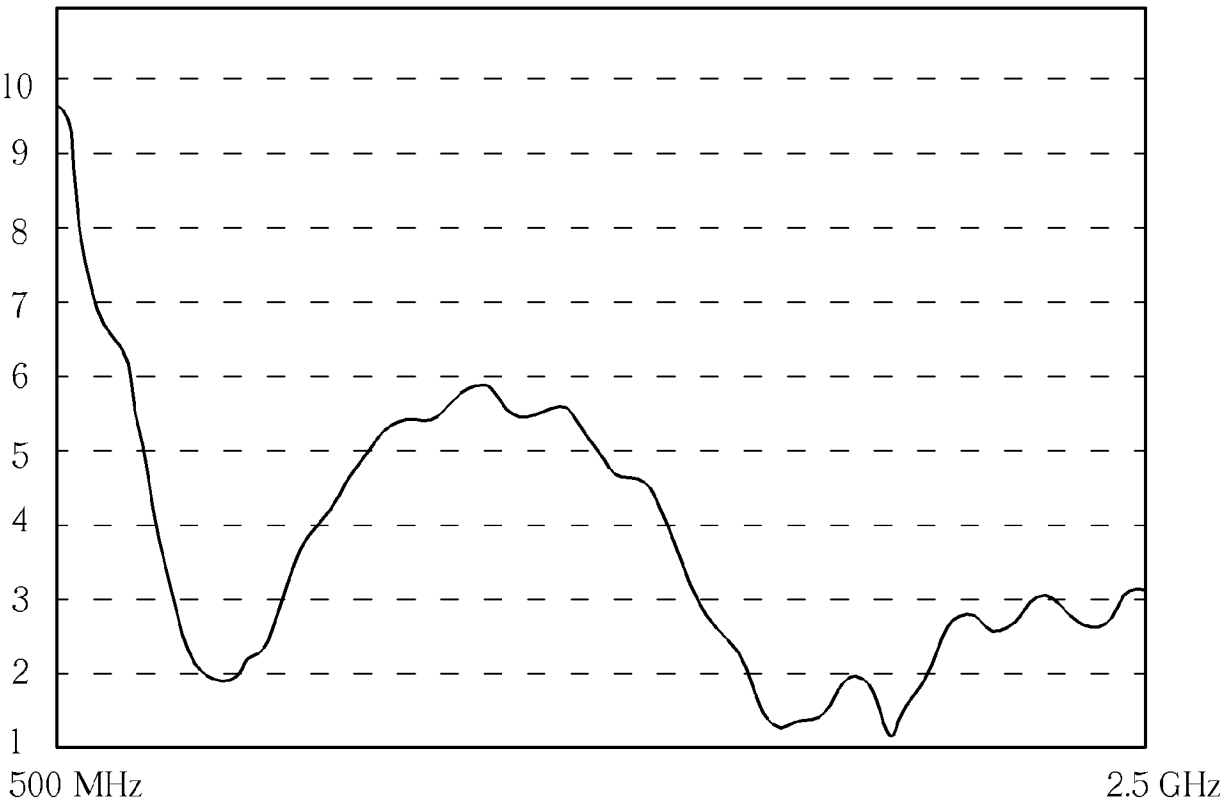
FIG. 9B is a schematic diagram of VSWR of the dualband wideband antenna shown in FIG. 9A at 0.5 GHz to 2.5 GHz.

In addition, please refer FIG. 9A and FIG. 9B. FIG. 9A illustrates a schematic diagram of a dualband wideband antenna 90 according to an embodiment of the present invention, and FIG. 9B illustrates VSWR of the dualband wideband antenna 90 at 0.5 GHz to 2.5 GHz. The dualband wideband antenna 90 is utilized for a radio transceiver device, and comprises a first radiating element 900, a second radiating element 902, a grounding unit 904, a connection strip 906, a feeding terminal 908 and a parasitic radiating element 910. Comparing FIG. 8A with FIG. 9A, the structure of the dualband wideband antenna 90 is similar to that of the dualband wideband antenna 80, while the parasitic radiating element 910 of the dualband wideband antenna 90 extends from the connection strip 906 but is not coupled to the second radiating element 902, which can also enhance the matching effect to make the dualband wideband antenna 90 reach better radiation efficiency. As shown in FIG. 9B, an ultra low frequency bandwidth (around 817 MHz, and VSWR≦3) of the dualband wideband antenna 90 is about 206 MHz and the bandwidth efficiency is about (206/817)*100%=25.2%.

Figure 10A:
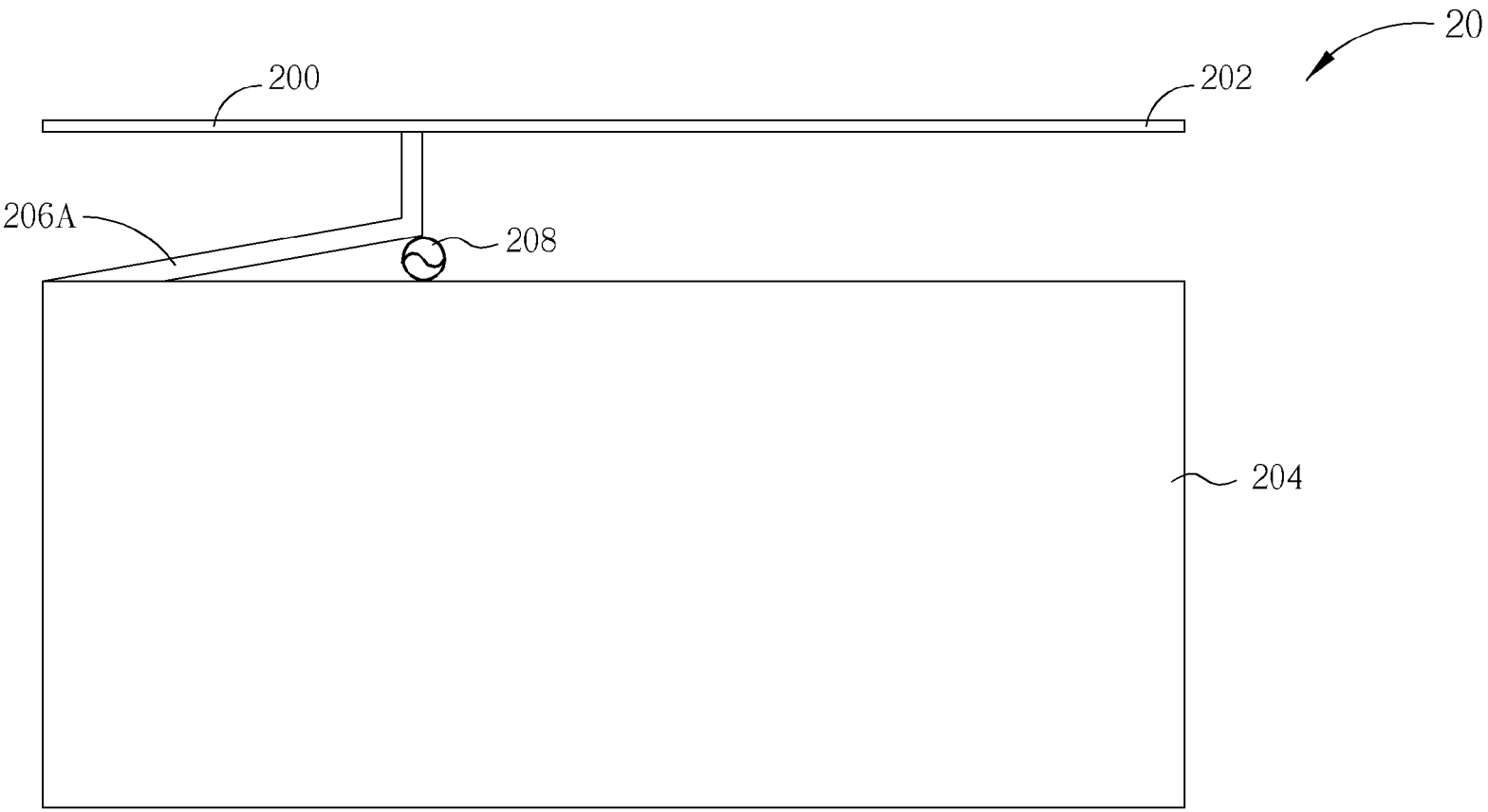
FIG. 10A to FIG. 10H are schematic diagrams of replacing a connection strip of the dualband wideband antenna shown in FIG. 2 with different connection strips.
Figure 10B:
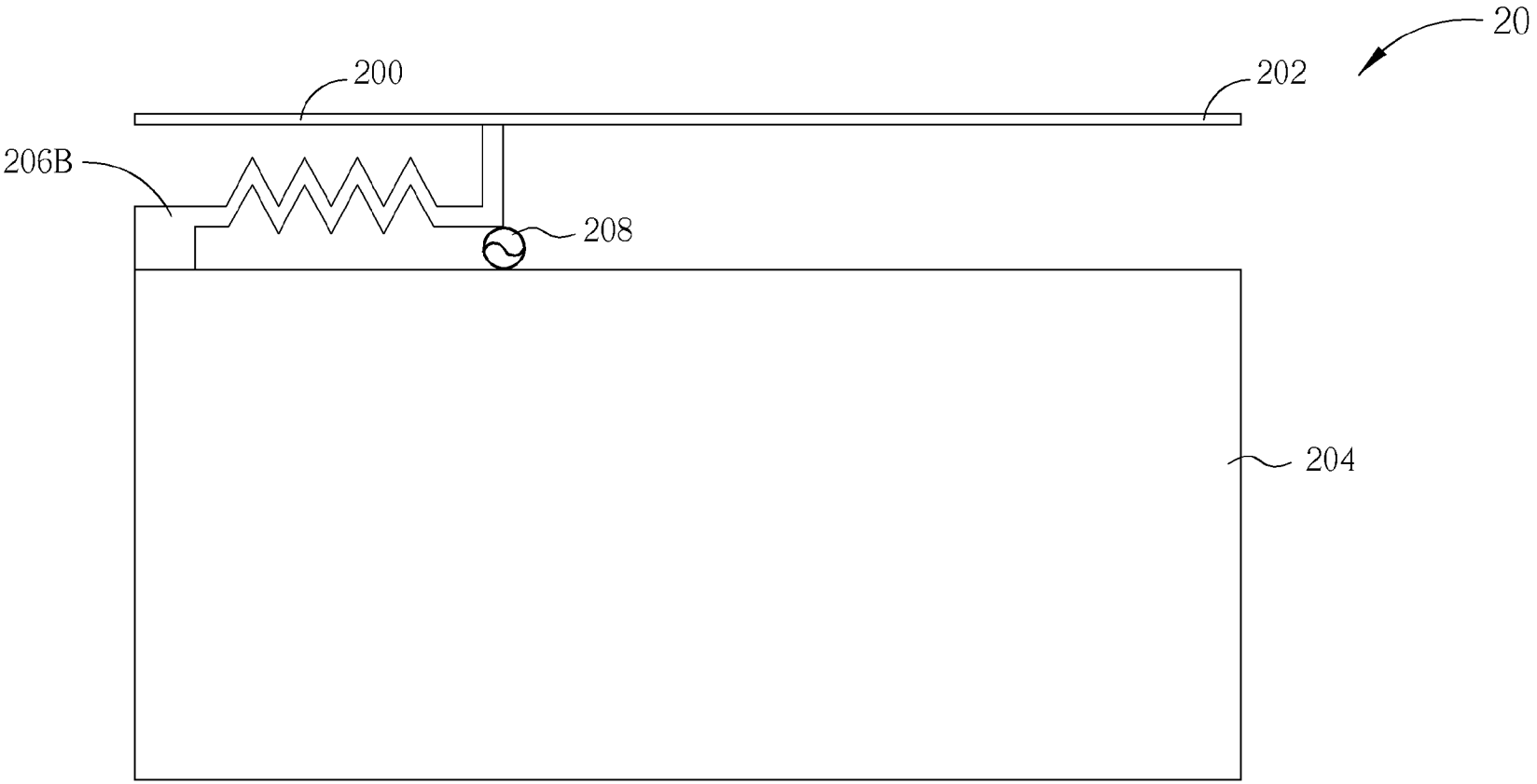
Figure 10C:
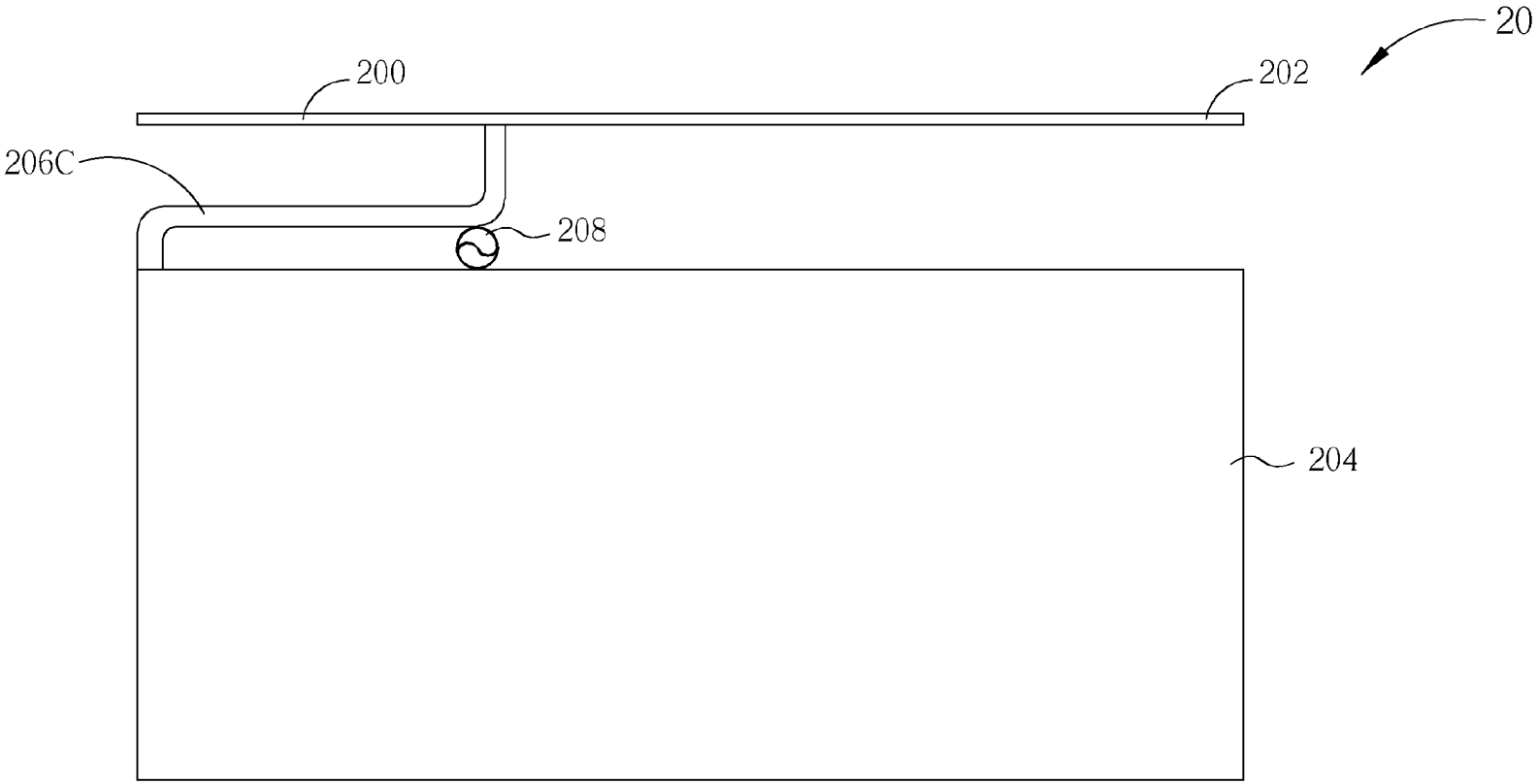
Figure 10D:
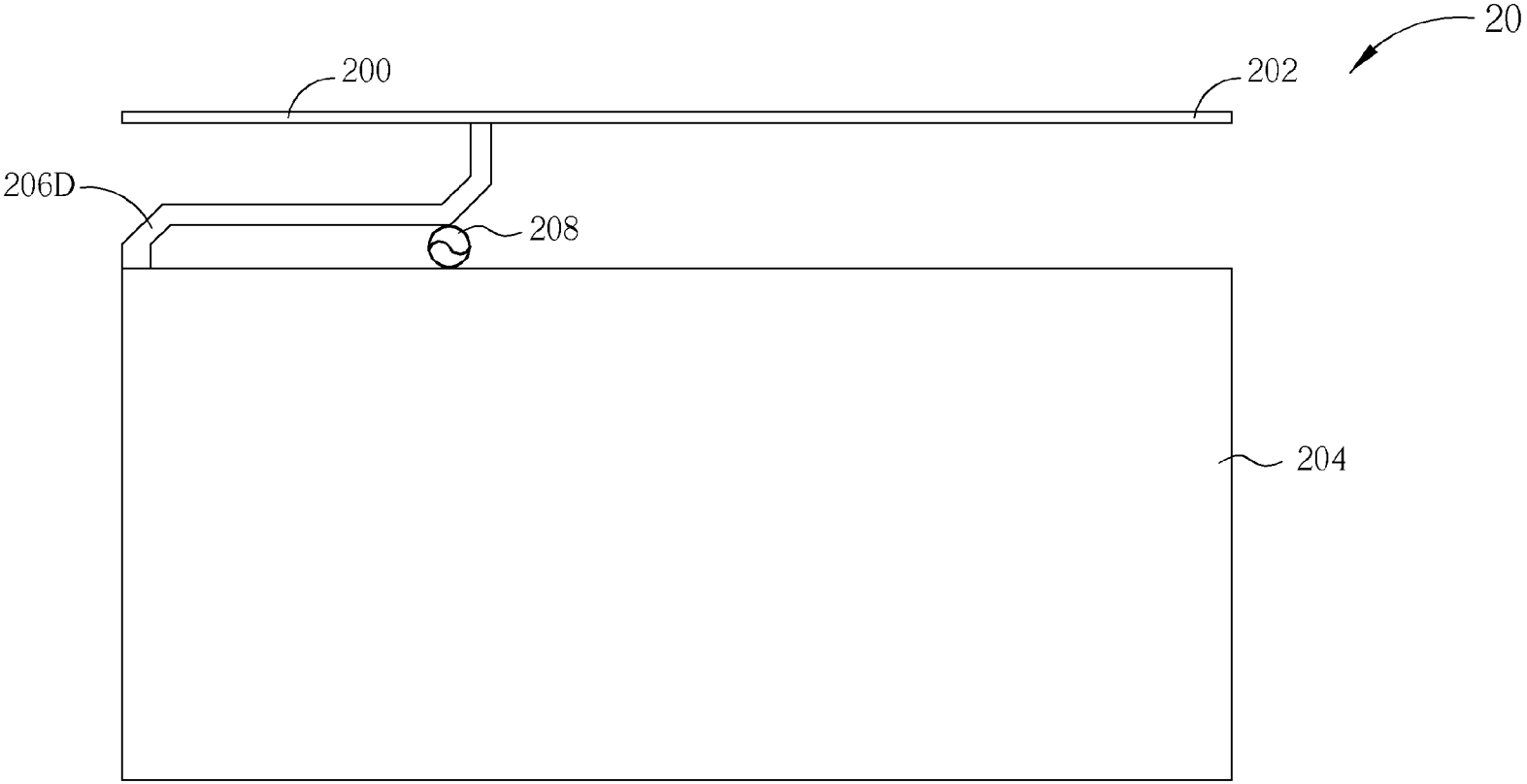
Figure 10E:
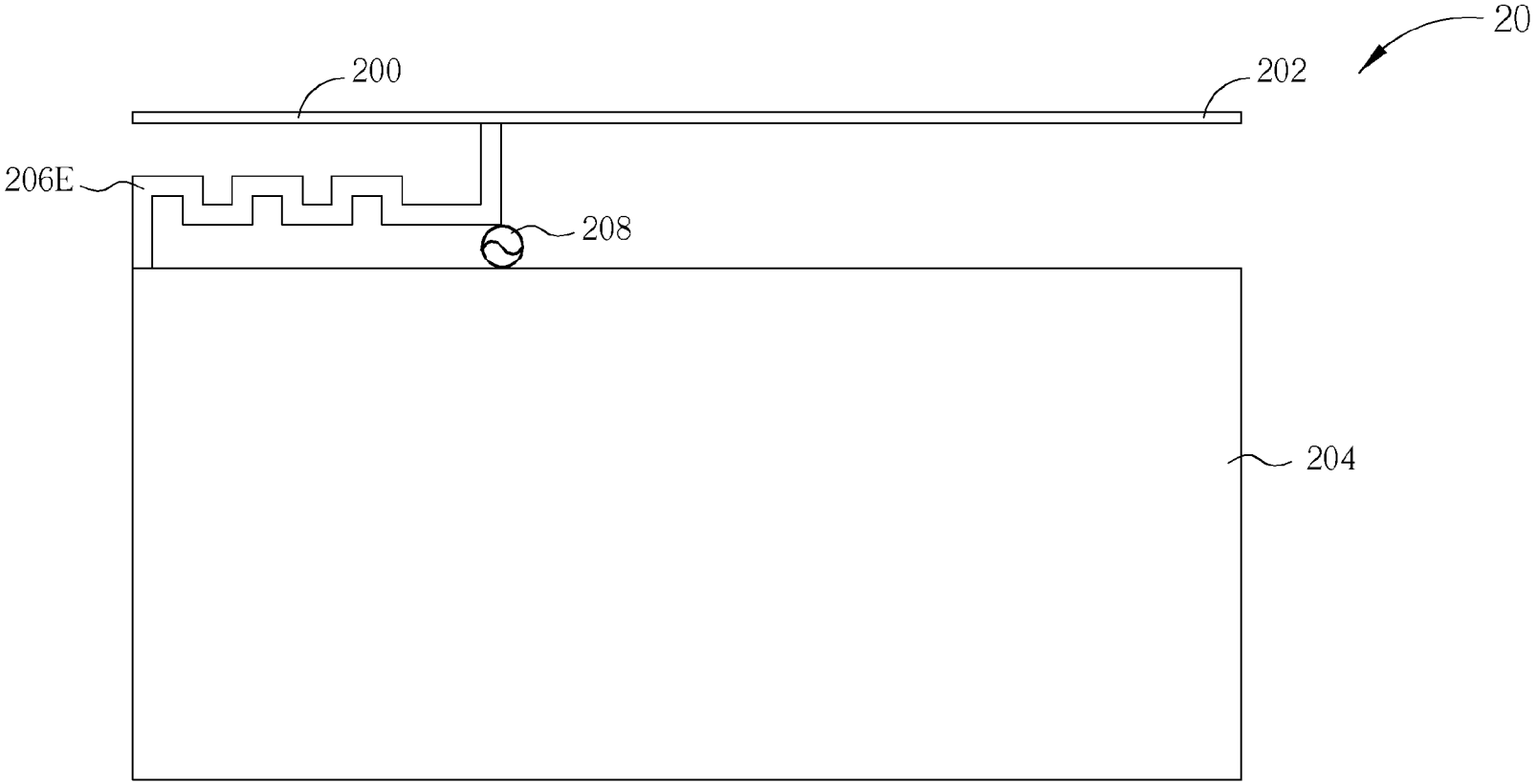
Figure 10F:
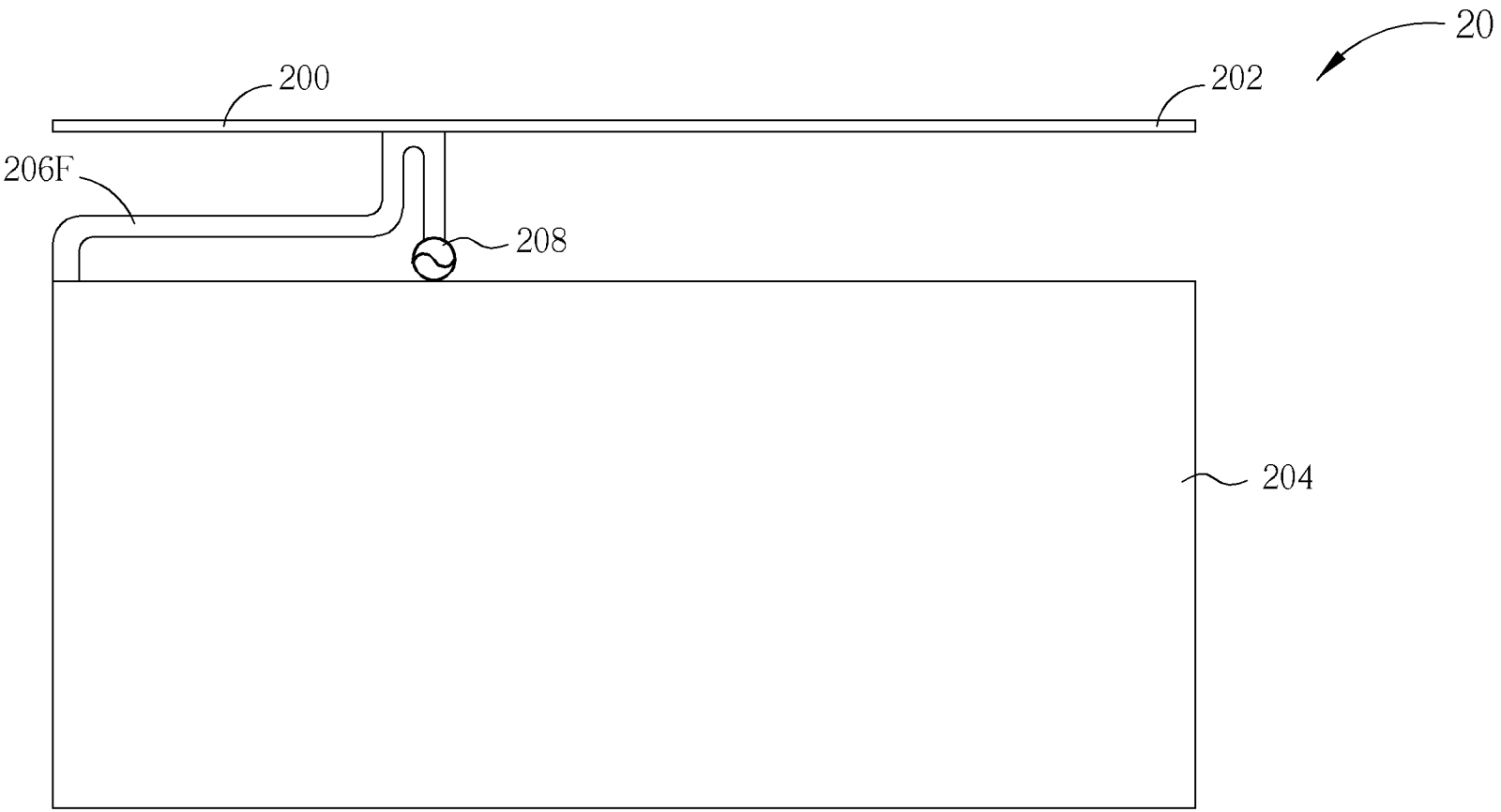
Figure 10G:
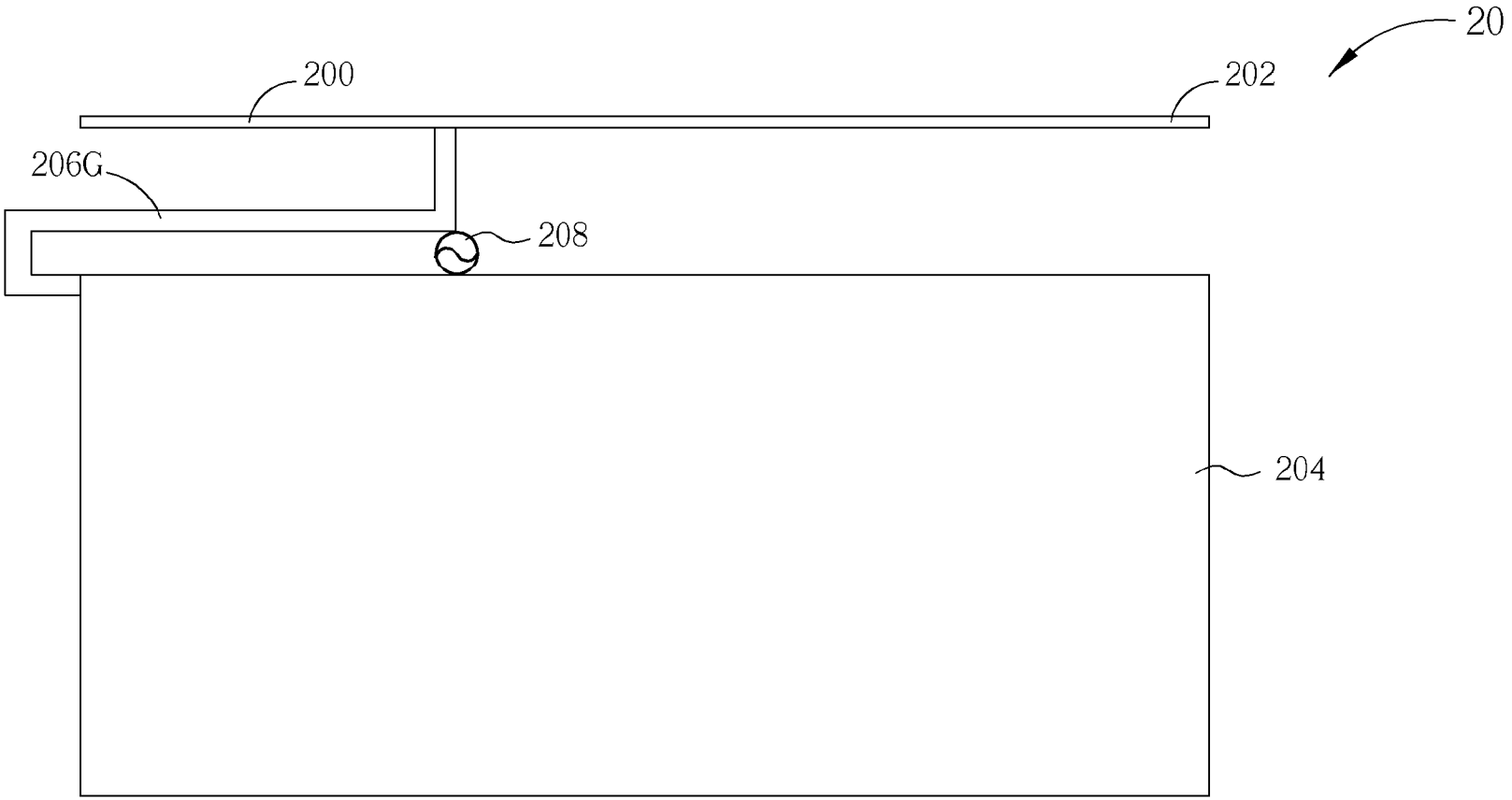
Figure 10H:
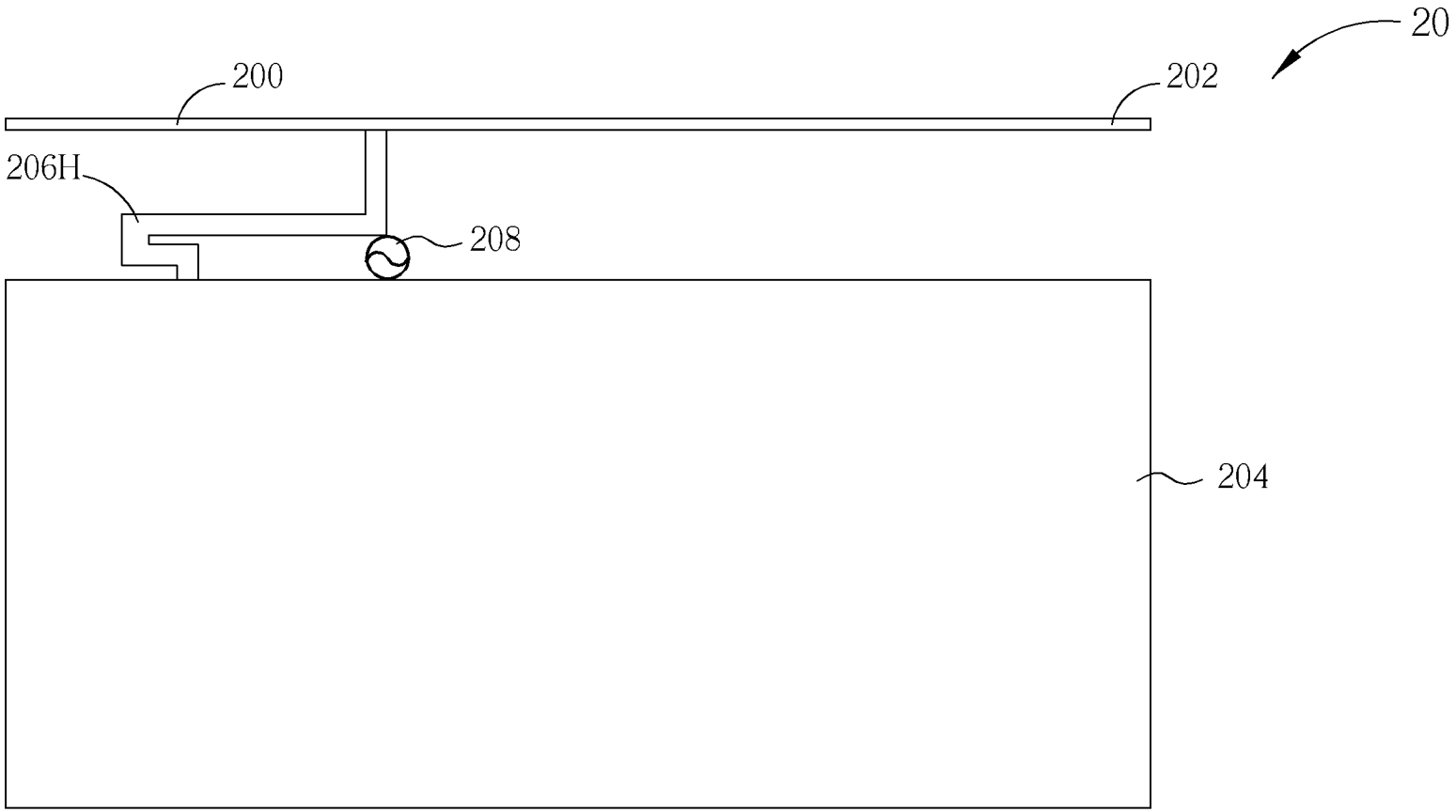

On the other hand, the invention idea of the present invention is to extend the connection strip 206 toward the high frequency radiating element, so as to increase the low frequency bandwidth of the dualband wideband antenna 20. Therefore, other designing considerations, such as pattern, material, etc. of the connection strip 206, are not limited as long as the dualband wideband antennal 20 functions normally. For example, please refer FIG. 10A to FIG. 10H. FIG. 10A to FIG. 10H illustrate schematic diagrams of replacing the connection strip 206 of the dualband wideband antennal 20 with connection strips 206A to 206H respectively. As shown in FIG. 10A, the connection strip 206A only includes two arms, one of which is obliquely disposed between the grounding unit 204 and another arm. As shown in FIG. 10B, the connection strip 206B includes three arms, one of which includes a saw-tooth structure. As shown in FIG. 10C, three arms of the connection strip 206C connect with each other by a curve structure. As shown in FIG. 10D, three arms of the connection strip 206D connect with each other by a bevel structure. As shown in FIG. 10E, the connection strip 206E includes three arms, one of which includes a meander structure. As shown in FIG. 10F, the connection strip 206F includes four arms, one of which is used for connecting with the feeding terminal 208. As shown in FIG. 10G, the connection strip 206G includes four arms and three bends. As shown in FIG. 10H, the connection strip 206H includes five arms and four bends.

Figure 11A:
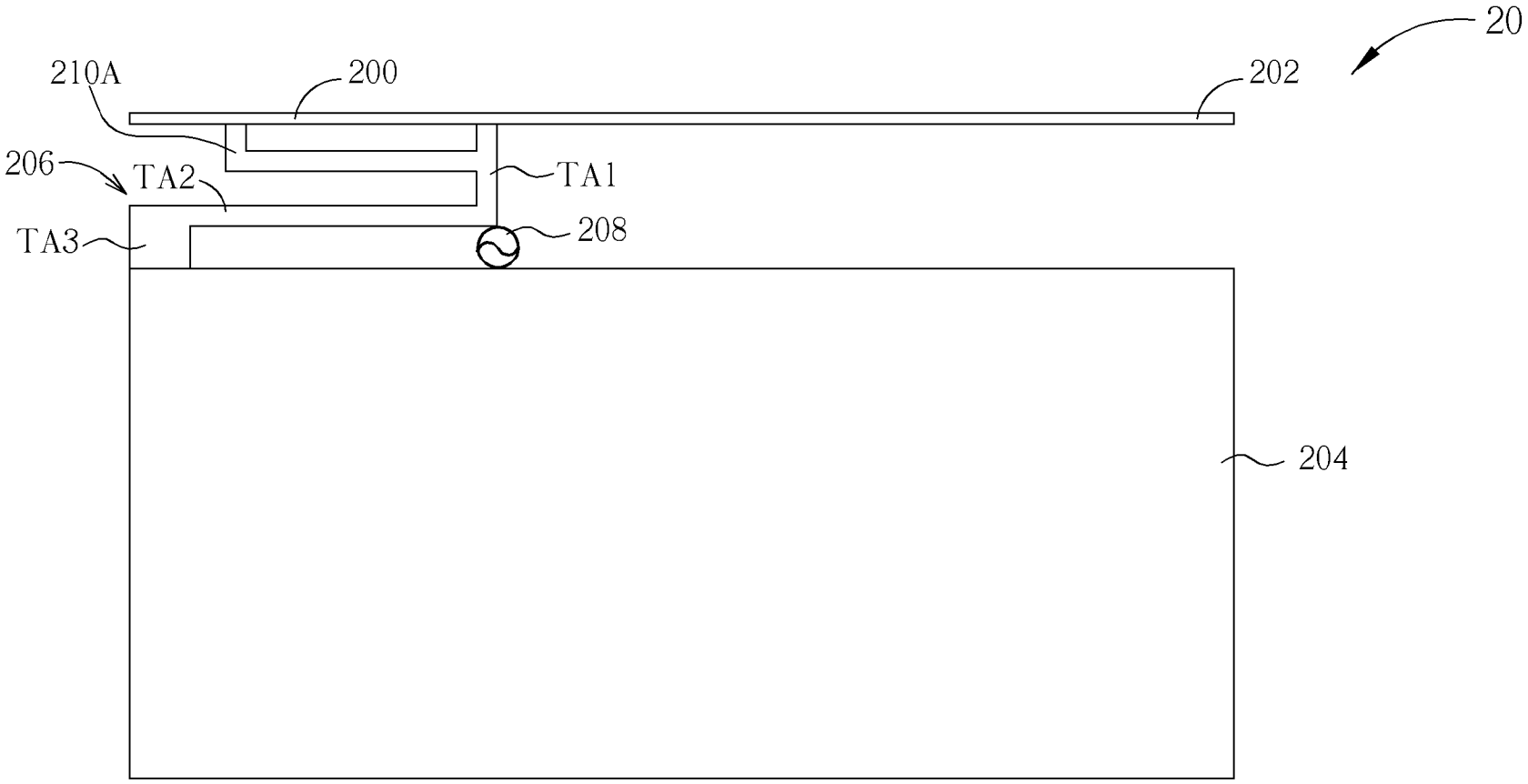
FIG. 11A to FIG. 11D are schematic diagrams of adding connection units to the dualband wideband antenna shown in FIG. 2.
Figure 11B:
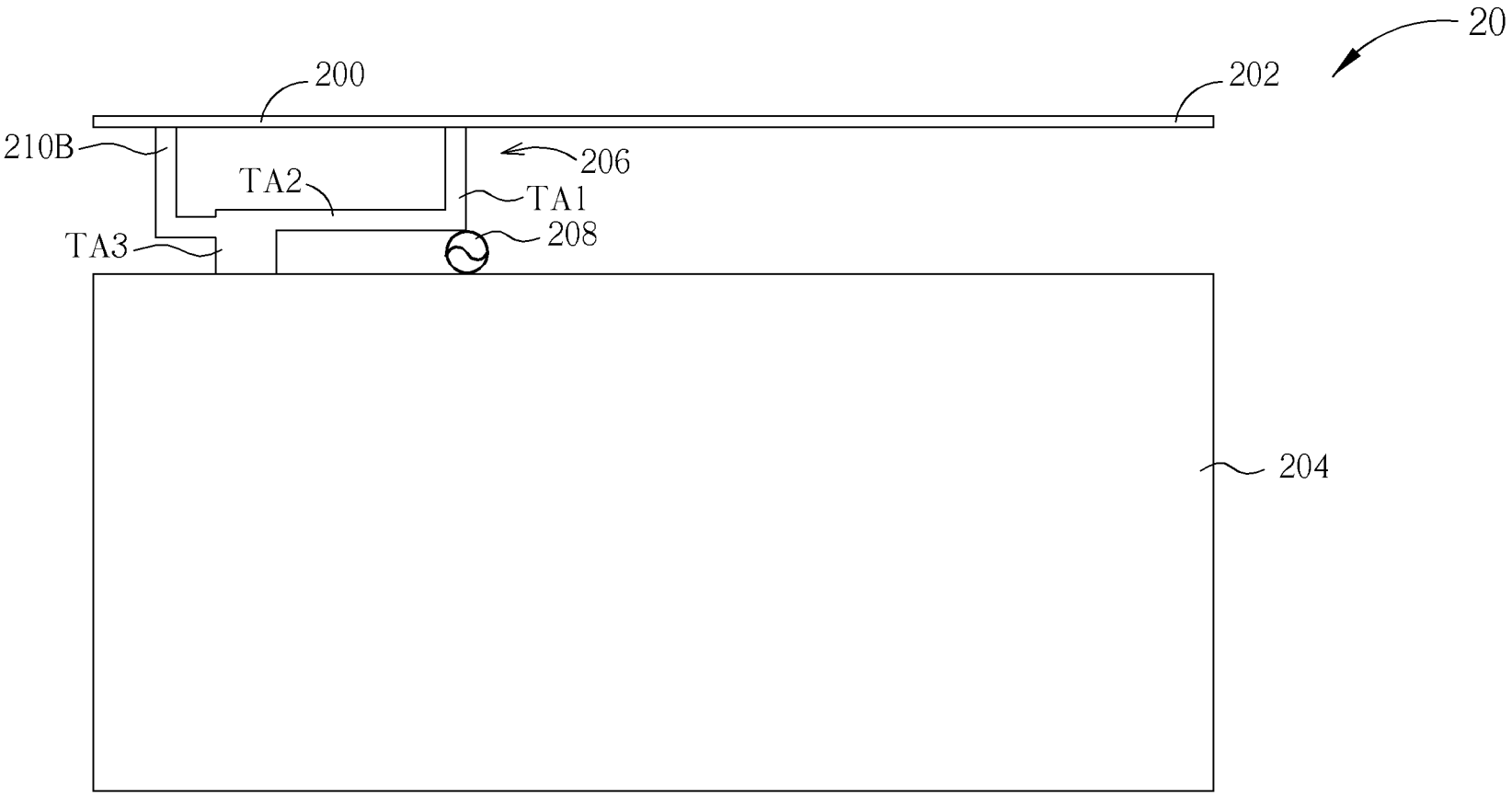
Figure 11C:
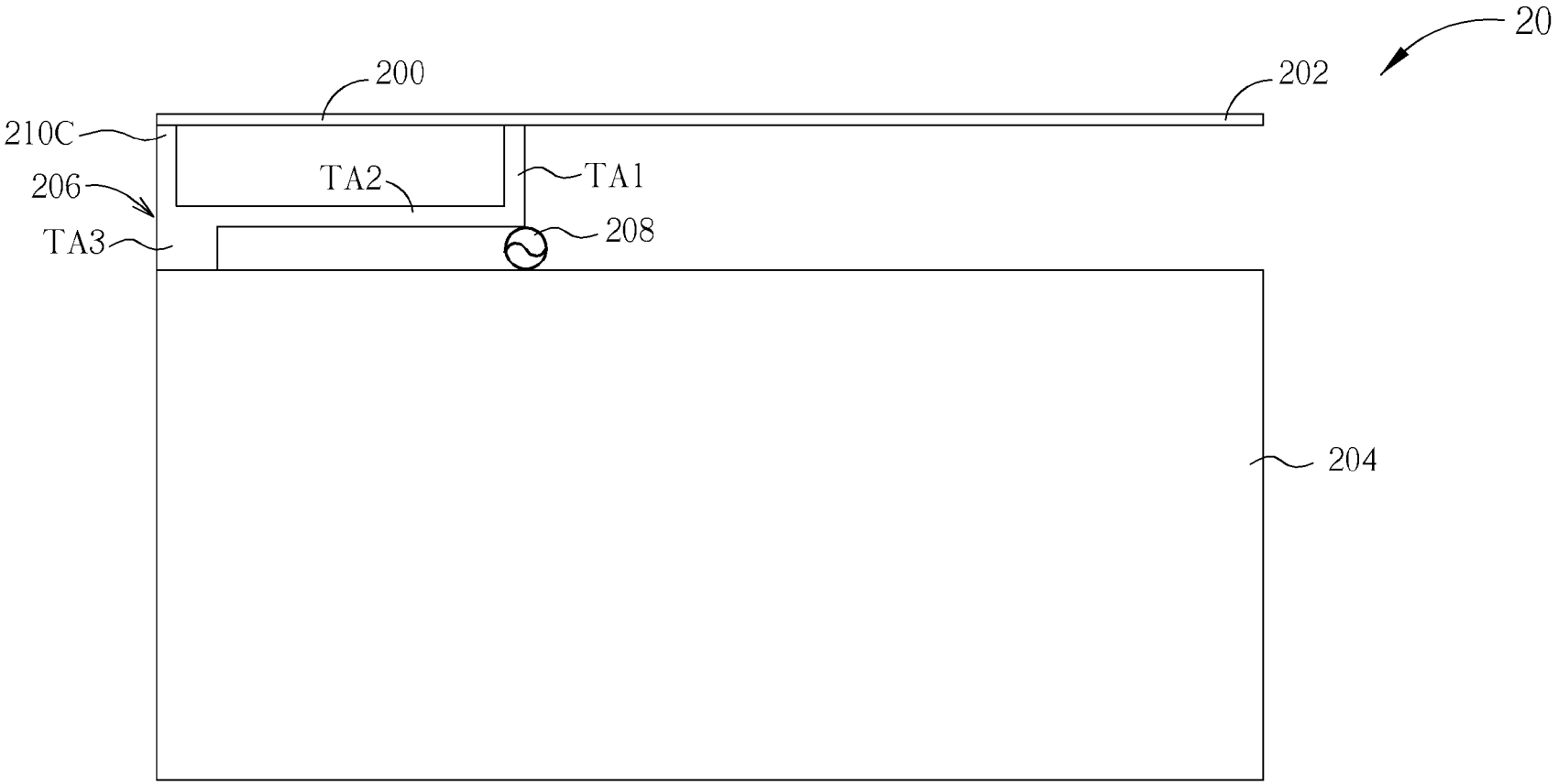
Figure 11D:
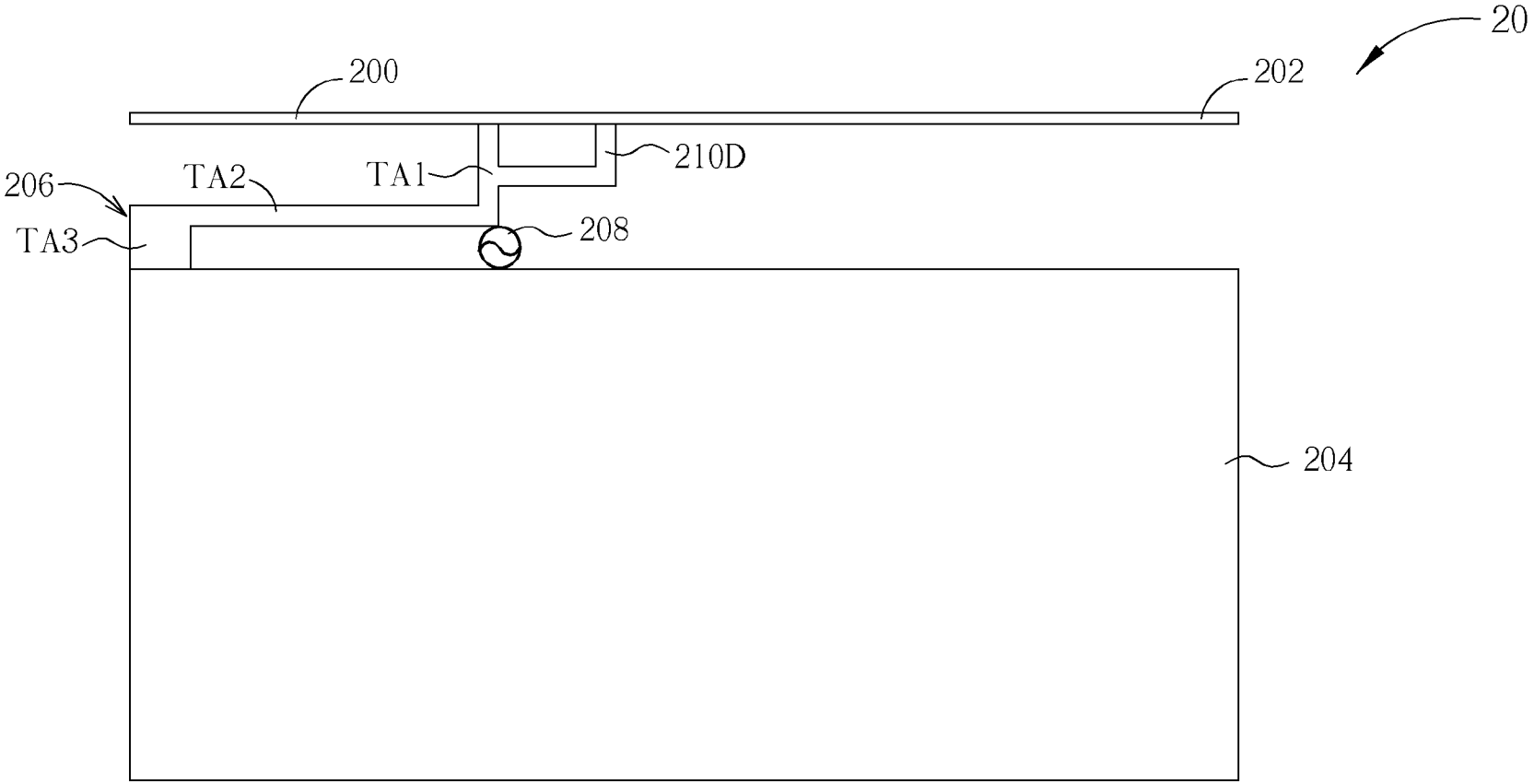

In addition, a connection unit can further be added to the dualband wideband antenna 20, for enhancing the radiation efficiency as well as the bandwidth. For example, please refer FIG. 11A to FIG. 11D. FIG. 11A to FIG. 11D illustrate schematic diagrams of the dualband wideband antennal 20 with additional connection units 210A to 210D respectively. As shown in FIG. 11A, the connection unit 210A includes two arms between the first arm TA1 of the connection strip 206 and the first radiating element 200. As shown in FIG. 11B, the connection unit 210B includes two arms between the third arm TA3 of the connection strip 206 and the tail of the first radiating element 200. As shown in FIG. 11C, the connection unit 210C is a single arm, and one end of the connection unit 210C is between the second arm TA2 and the third arm TA3 of the connection strip 206, and another end of the connection unit 210C connects to the first radiating element 200. As shown in FIG. 11D, the connection unit 210D includes two arms between the first arm TA1 of the connection strip 206 and the second radiating element 202.

Note that, FIG. 10A to FIG. 10H or FIG. 11A to FIG. 11D are used for describing possible variations of the dualband wideband antenna 20, and not limited to these. And, these variations can further be used in FIG. 8A or FIG. 9A.

In conclusion, in the present invention, the connection strip extends toward the high frequency radiating element of the dualband wideband antenna, such that current can be uniformly distributed on the low frequency radiating element, to obtain better omnidirectional radiation and increase the low frequency bandwidth.

Those skilled in the art will readily observe that numerous modifications and alterations of the device and method may be made while retaining the teachings of the invention.

What is claimed is:

1. A wideband antenna for a radio transceiver device, the wideband antenna comprising:

a first radiating element, for transmitting and receiving wireless signals of a first frequency band;

a second radiating element, for transmitting and receiving wireless signals of a second frequency band;

a grounding unit;

a connection strip, having an end coupled to the first radiating element and the second radiating element, and another end coupled to the grounding unit;

a feeding terminal, coupled to the connection strip, for transmitting and receiving wireless signals of the first frequency band and the second frequency band; and a parasitic radiating element including one end coupled to the connection strip between the grounding unit and the feeding terminal, and another end opened, for raising the matching effect;

wherein the second frequency band is lower than the first frequency band and the connection strip comprises a structure extending toward the first radiating element.

2. The wideband antenna of claim 1, wherein the connection strip comprises:

a first arm, coupled to the first radiating element and the second radiating element, and extending toward the grounding unit;

a second arm, coupled to the first arm, and extending toward the direction of the first radiating element; and a third arm, coupled to the second arm and the grounding unit.

3. The wideband antenna of claim 2, wherein the feeding terminal is coupled to the connection place of the first arm and the second arm.

4. The wideband antenna of claim 2, wherein the first arm is coupled to the second arm, and the second arm is coupled to the third arm.

5. The wideband antenna of claim 1, wherein the parasitic radiating element extends toward the first radiating element.

6. The wideband antenna of claim 1 further comprising a connection unit having an end coupled to the connection strip and another end coupled to the first radiating element.

7. The wideband antenna of claim 1 further comprising a connection unit having an end coupled to the connection strip and another end coupled to the second radiating element.

* * * * *